US005182007A

United States Patent [19]

Takagi et al.

[11] Patent Number: 5,182,007

[45] Date of Patent: Jan. 26, 1993

[54] STAIN PREVENTING METHOD

[75] Inventors: Kazo Takagi, Chiba; Shigeoki Nakamura, Nagareyama; Chisei Murayama, Kashiwa, all of Japan

[73] Assignee: Daiki Engineering Co., Ltd., Tokyo, Japan

[21] Appl. No.: 735,133

[22] Filed: Jul. 23, 1991

[30] Foreign Application Priority Data

Jul. 23, 1990 [JP] Japan ..... 2-194257

[51] Int. Cl.[5] ..... C23F 13/00

[52] U.S. Cl. ..... 204/147; 204/130; 204/196

[58] Field of Search ..... 204/147, 148, 196, 197, 204/130

[56] References Cited

U.S. PATENT DOCUMENTS

| | | | |
|---|---|---|---|
| 994,405 | 6/1911 | James | 204/196 |
| 1,021,734 | 3/1912 | Deius et al. | 204/147 |
| 3,208,928 | 9/1965 | Landers et al. | 204/196 |
| 3,497,434 | 2/1970 | Littauer | 204/196 |
| 3,661,742 | 5/1972 | Osborn et al. | 204/196 |
| 3,766,032 | 10/1973 | Yelser | 204/196 |
| 4,196,064 | 4/1980 | Harms et al. | 204/196 |

*Primary Examiner*—T. Tung
*Attorney, Agent, or Firm*—Armstrong & Kubovcik

[57] ABSTRACT

A stain preventing method comprises: lining a conductive sheet on an article subjected to stain prevention; arranging an electrode member and a reference electrode in sea water; applying direct electric current using the conductive sheet as an anode and the electrode member as a cathode; allowing a current to flow while controlling a potential difference between the reference electrode and the anode to be in a certain range; and thereby giving electric shock to microorganisms which contact with the conductive sheet so as to prevent adhesion thereof. Stain prevention can be effectively carried out without generating substances harmful for life such as chlorine due to electrolysis of sea water.

4 Claims, 7 Drawing Sheets

FIG. 2
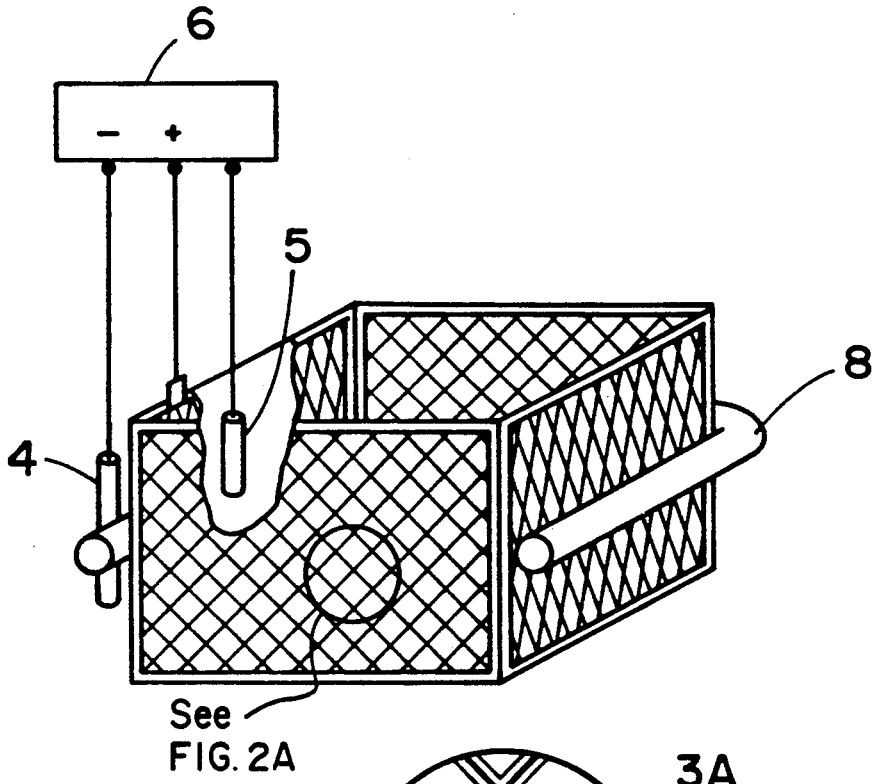
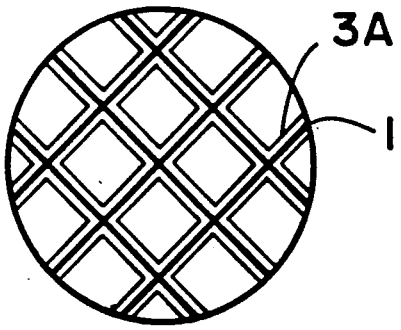
FIG. 2A

STAIN PREVENTING METHOD

BACKGROUND OF THE INVENTION

1. Field of the Invention

The present invention relates to a method for preventing staining by adhesion of organisms to marine structures, marine vessels, pipelines or channels for transferring sea water, fishing nets and fish preserve nets, or screens of sea water intake ports, which includes an apparatus for carrying out the method.

2. State of the Art

To portions which always contact with sea water such as pipe lines for transferring sea water as cooling water and screens of sea water intake ports in power plants, ship's piers, floating stations, bridge girders, marine organisms such as various seaweeds, barnacles and other shellfishes adhere, and the adhesion causes problems such as decrease in water intake amount, decrease in navigation speed of marine vessels. Therefore, adhered marine organisms must be removed at regular intervals, which is a difficult operation.

The mechanism of adhesion of marine organisms follows such an order that at first microorganisms such as a red tide microorganism adhere to allow a organism coating film to be formed, and larvas of large organisms such as barnacles adhere thereto. Therefore, to prevent adhesion of microorganisms and prevent adhesion and growth of large organisms is an effective solving measure for the above mentioned problems, and various procedures for which have been proposed.

The first one thereof is to make the surface which contacts with sea water to be smooth. It is difficult for the organisms to adhere to the smooth surface, but its effect is only at early stages, consequently resulting in suffering adhesion. Therefore, this not a long-lasting countermeasure.

Those procedures which are often used for preventing stains of ships are paints containing an organic tin compound. The organic tin compound elutes from a paint film of the stain preventing paint to sea water, and kills bacteria in the neighborhood, thereby adhesion of marine organisms can be prevented. The effect of the stain preventing paint generally continues only about two years, so that repainting is necessary at regular intervals, and the ship must be entered into a dry dock. This procedure cannot be applied to the fixed structures, and use of the stain preventing paint is also being restricted due to pollution of the environment.

As a stain preventing method for pipelines for transferring sea water, there is a method in which chlorine is injected into the pipes. Since chlorine is harmful, another problem takes place for handling it.

There is a method in which copper or a copper alloy is used as an electrode to arrange closely near to an article subjected to stain prevention to give an anode, and direct current is allowed to flow to generate copper ion (Japanese Patent Disclosures No. 61-136689, No. 61-221382, No. 61-221383, No. 61-221384 and No. 63-142109). Also, there is a method in which an insoluble electrode is used, and sea water is electrolized to generate chlorine ion (Japanese Patent Disclosures No. 63-101464, No. 63-103789, No. 64-87791 and No. 64-168224). In these methods, a bacteriocidal substance generated by electrochemical reaction covers surroundings of the article subjected to stain prevention, thereby stain prevention is performed. Thus, application of this method is difficult where sea water flows fast. In addition, it is not preferable to generate the substance which is harmful for living bodies.

SUMMARY OF THE INVENTION

The object of the present invention is to provide a method for effectively performing stain prevention without pollution of the environment and with a relatively small investment and a low running cost, and an apparatus for carrying out the method.

The stain preventing method of the present invention is a method for preventing stains due to adhesion of marine organisms to structures, marine vessels, or pipelines contacting with sea water, which basically comprises performing direct lining of a conductive sheet, namely, through no insulating material to a stain prevention-requiring portion of an article subjected to stain prevention, arranging an electrode member and a reference electrode in sea water so as not to contact with the conductive sheet, applying a direct current using the conductive sheet as an anode and the electrode member as a cathode, allowing a feeble current to flow with measuring a potential difference between the reference electrode and the anode and controlling it to be in a certain range, and giving an electric shock to microorganisms which have contacted with the conductive sheet so as to prevent adhesion thereof.

As illustrated in FIG. 1 as an example of a station ship, the stain preventing apparatus of the present invention for carrying out the method is essentially constructed with a conductive sheet (3) which is lined on a stain prevention-requiring portion of an article subjected to stain prevention (1) which contacts with sea water (9), an electrode member (4) and a reference electrode (5) arranged in sea water so as not to contact with the conductive sheet, and a direct current power supply (6) wherein the direct current power supply has a function for controlling a potential difference between the reference electrode and the anode to be in a certain range, and each of them is connected with the direct current power supply so as to use the conductive sheet as the anode and the electrode member as a cathode, respectively.

BRIEF EXPLANATION OF THE DRAWINGS

FIG. 1 to FIG. 7 are figures for explaining an example of the stain prevention method and the stain preventing apparatus according to the present invention; wherein, FIG. 1 shows an example of application to a station ship;

FIG. 2 shows an example of application to a net;

FIG. 3 shows an example of application to a pipeline;

FIG. 4 shows a example of application to a water channel made of concrete;

FIG. 5 shows an example of application to a marine vessel;

FIG. 6 shows an example of application to a bridge girder; and

FIG. 7 shows an example of application to a buoy, respectively.

DETAILED EXPLANATION OF THE PREFERRED EMBODIMENTS

Figure 1:
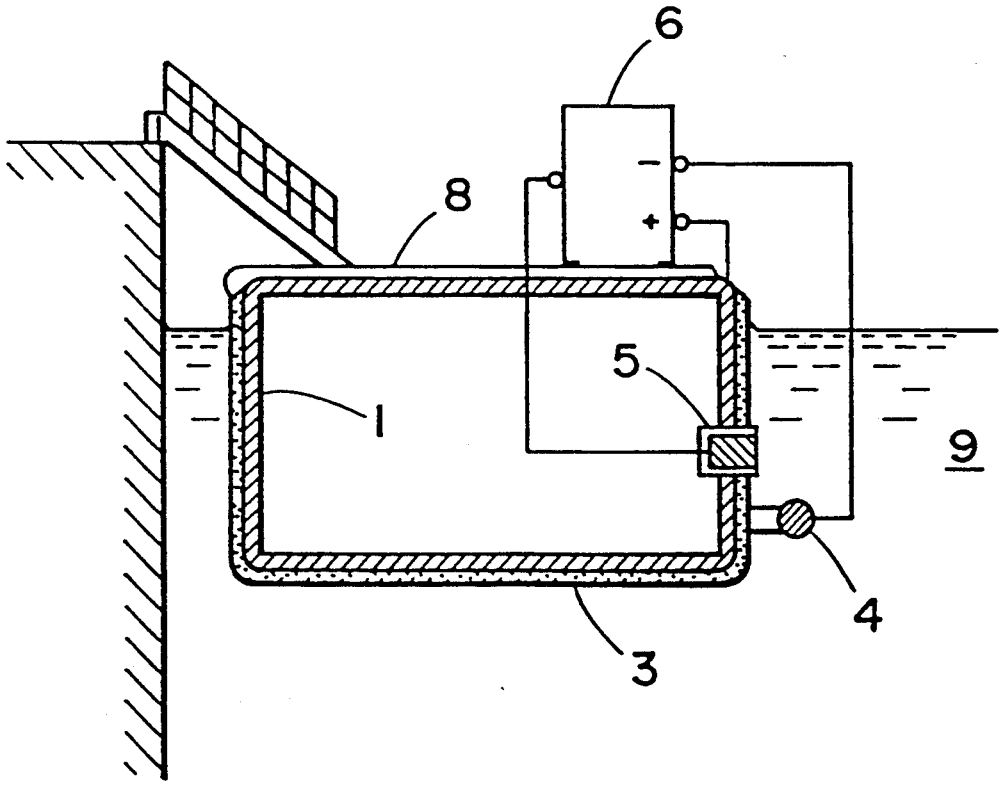

Application of direct current may be done, depending on conditions of environments in which stain prevention should be carried out, to make the anode potential to be in a range of 0.5 to 1.5 V(with respect to SCE), and adhesion of microorganisms can be usually prevented within this range wherein no generation of chlorine due to electrolysis of sea water is also observed.

A simple method for providing the conductive sheet at the article subjected to stain prevention is the rubber lining method. That is the method in which an insoluble conductive substance is mixed with rubber by kneading to form a sheet, and the sheet thus formed is sticked with an adhesive. As the rubber, for example, chloroprene rubber, butyl rubber, ethylene propyrene rubber, fluorine rubber, ethylene propyrene rubber, fluorine rubber, chlorosulfonated polyethylnene rubber are preferable.

Instead of rubber, a thermoplastic resin such as polyvinyl chloride, polyethylnene, polyamide is used, and a mixture of powder thereof and powder of a conductive substance is prepared, which may be made to be the conductive sheet by means of a method of powder lining.

As the example of the insoluble conductive substance, a valve metal such as Ti, Ni and Ta, a metal of the platinum group or an oxide thereof, metal oxides such as $PbO_2$, $MnO_2$, $Fe_2O_3$, carbonaceous materials such as graphite and carbon black, and silver-lead alloys, are listed.

Examples of the compounds of a rubber or a thermoplastic resin and a conductive substance are shown below.

| No. | 1 | 2 | 3 | 4 | 5 | 6 |
|---|---|---|---|---|---|---|
| Polymer material (parts by weight) | | | | | | |
| Rubber | 100 | 100 | 100 | | | |
| Polyvinyl chloride | | | | 100 | | |
| Polyethylene | | | | | 100 | |
| Nylon | | | | | | 100 |
| Conductive substance (parts by weight) | | | | | | |
| Carbon black | 30 | 15 | 10 | 10 | 10 | 10 |
| Graphite | 40 | 10 | 10 | 10 | 10 | 10 |
| Volume specific resistance (ohm-cm) | $10^2$ | $10^3$ | $10^5$ | $10^5$ | $10^5$ | $10^5$ |

A thickness of the conductive sheet is preferably not less than 500 um, especially not less than 3 mm in order to give durability. A thick sheet can be used for a long time to that extent, which is expensive to that degree, so that it may be not more than 10 mm, preferably not more than 5 mm.

As the electrode member a rod-shaped body of a titanium base material, a silver-lead alloy, or a carbonaceous material on which a noble metal is galvanized or a noble metal oxide is coated are suitable. It is necessary to arrange both of the electrode member and the conductive sheet so as not to directly contact, for which it is suitable that the electrode member is coated with a tube of an insulating material.

For the direct current power supply, a commercially available rectifier ma be used.

With respect to the stain preventing method and the stain preventing apparatus according to the present invention, various embodiments are possible depending on types of the article subjected to stain prevention.

For example, as shown in FIG. 2, when the article subjected to stain prevention is a net, a conductive coating film (3A) is formed on the net which is the article subjected to stain prevention (1), and the coated film is utilized as an anode.

In the present invention, the conductive sheet is directly subjected to lining to the article subjected to stain prevention without interposing an insulating material, so that, when the article subjected to stain prevention is an electrically good conductor, as shown in FIG. 1 to FIG. 3 or FIG. 7, the article subjected to stain prevention (1) can be utilized as the electric current feeding member.

Figure 4:
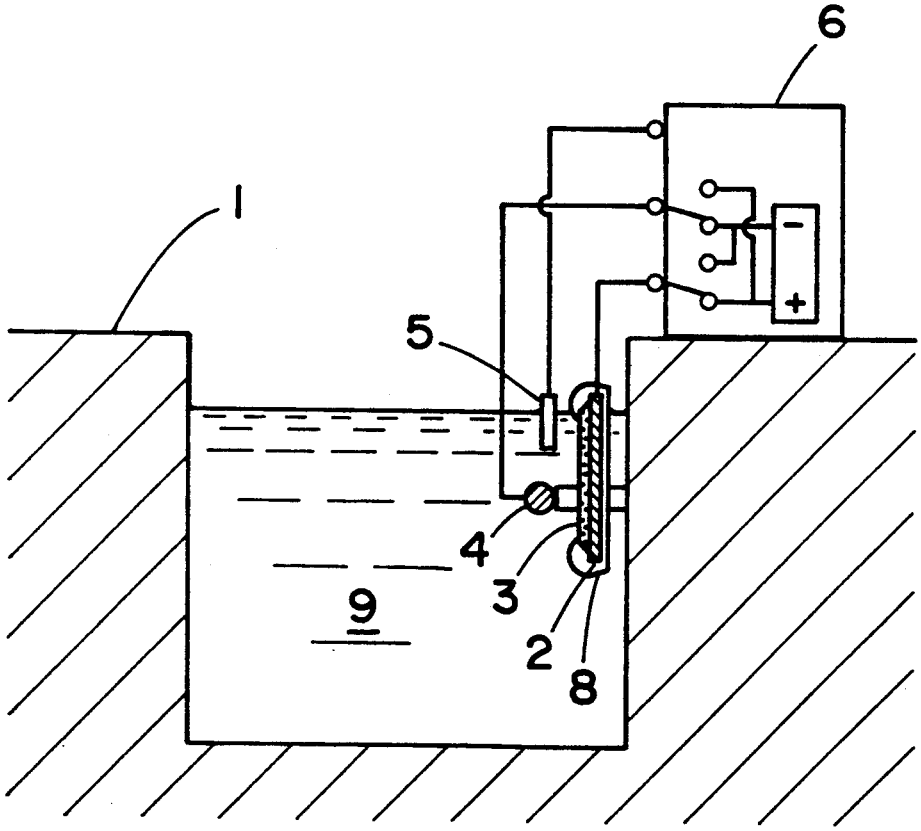
Figure 5:
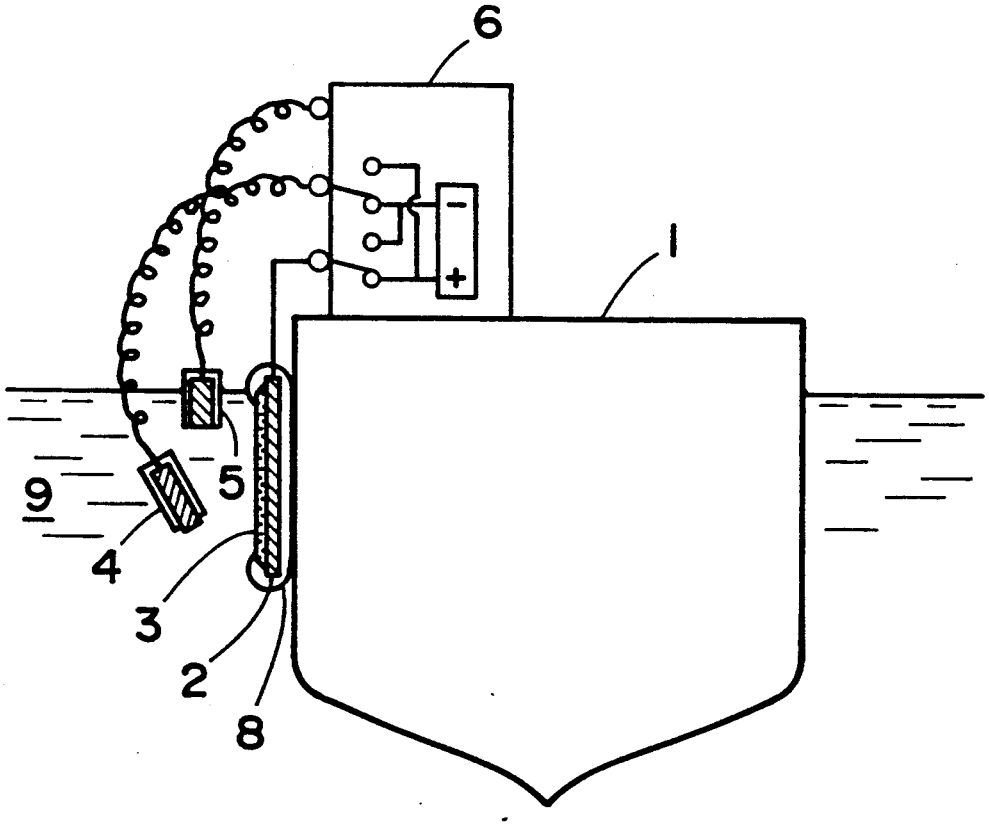
Figure 6:
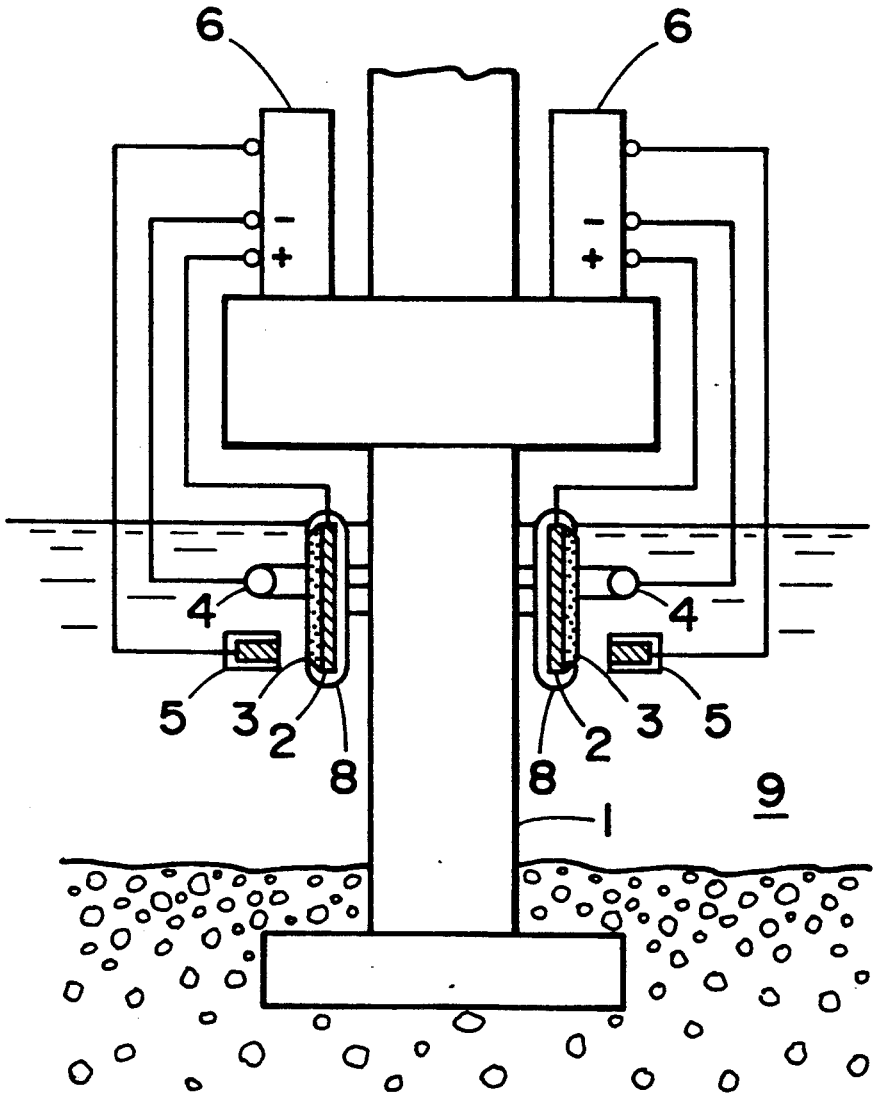

When the article subjected to stain prevention is one on which the conductive sheet cannot be directly lined, such as a structure made of concrete, or when it is not suitable to line the conductive sheet on the article subjected to stain prevention, a procedure may be available in which an electric current feeding member (2) is provided as a conductive supporting structure closely near to an article subjected to stain prevention (1), on which a conductive sheet (3) is lined as an anode, as shown in FIG. 4 to FIG. 6. For the electric current feeding member, a plate or a net made of a metal represented by steel and stainless steel may be used.

With respect to attachment of the electric current feeding member, a suitable means may be selected depending on a structure of the article subjected to stain prevention, and for example, it may be possible that a supporting member is provided at the article subjected to stain prevention to which it is screwed to fasten, or it may be hung by wire. It is preferable that the electric current feeding member is attached so as to closely contact with the article subjected to stain prevention, however, it is permissible that a small gap exists between them.

The polarity of the conductive sheet (3) may be sometimes alternated with that of the electrode member (4). Current application is continuously performed if necessary, however, it is a matter of course that it may be performed intermittently if unnecessary. These embodiments can be carried out by giving such functions to the direct current power supply unit.

When the article subjected to stain prevention is a long or large article, it is preferable that the surface of the article subjected to stain prevention may be divided into suitable sections, and stain prevention is carried out at each section.

In the stain preventing method and the stain preventing apparatus according to the present invention, the conductive sheet is lined on the article subjected to stain prevention, or on the electric current feeding member arranged closely near to the article subjected to stain prevention, and a certain electric potential is given to it, thereby electric shock is given to microorganisms and larvas of large organisms which have contacted with the conductive sheet, so as to prevent adhesion of the microorganisms and the larvas of large organisms thereto. As described above, unless the microorganisms adhere, no organism coating film is formed, and thus no seaweed grows and no larva of barnacle and blue mussel adheres and grows. It is not accompanied by generation of harmful substance such as chlorine ion or copper ion, so that there may be no fear for pollution of the environment.

The reference electrode is arranged to control the potential difference, so that it may be prevented that the potential becomes too rich and sea water is electrolyzed to generate chlorine.

According to the embodiment in which the porality of the anode is alternated with that of the cathode, and the embodiment in which current application is performed intermittently, the life of the conductive sheet and the electrode member can be prolonged. If the polarity alternation is possible, when a part of the conductive sheet peels off to expose the article subjected to stain prevention or the electric current feeding member, they can be switched into a cathode to prevent suffering from electrolytic corrosion. If the reference electrode is utilized to immediately detect the above mentioned trouble so as to be able to perform polarity alternation automatically, the safety is enhanced.

However, the apparatus according to the present invention uses the conductive sheet, so that it has high durability as compared with a conventional stain preventing apparatus in which a paint film of conductive paint is used. It is needless to say that, in the case of thin coating film such as paint film, deficiency is apt to take place due to sand, stone, shell in sea water, and this problem is evident in such a field in which flow speed is high such as pipelines.

According to the stain preventing method of the present invention, adhesion of marine organisms can be prevented. As mentioned before, elimination of adhered marine organisms is a difficult operation, and it is often accompanied by danger, but such operation becomes unnecessary when the method of the present invention is practiced. Moreover, the method of the present invention, which is different from the conventional method in which stain prevention is performed by generating a substance harmful for life, has no apprehension for the pollution of the environment.

The stain preventing apparatus according to the present invention is useful for carrying out the above mentioned method. This apparatus uses the sheet-shaped article as the anode, so that it may be used even in places where flow is rapid or waves are rough.

The stain preventing technique according to the present invention can be applied to all fields in which adhesion of marine organisms cause problems in addition to each of the above mentioned cases, which is a safe and certain solving means.

EXAMPLES

Example 1

Ten steel pipes having flanges at both ends ("100 A" in bore diameter and 1 m in length) were prepared. An internal surface of each of them was lined with a conductive rubber sheet which was prepared by mixing and kneading 100 parts by weight of chloroprene rubber with 30 parts by weight of carbon black and 40 parts by weight of graphite, and extruding. A thickness of the sheet after vulcanization was 5 mm. All parts having no lining of the conductive sheet such as the flange surface and the outer peripheral surface of the steel pipe were coated with an insulating material.

A column of silver was coated with an insulating material so as to expose a part of the forward end surface thereof, and a lead is connected to the backward end to prepare a reference electrode. Each of the coated steel pipes was subjected to drilling to make a hole at a middle portion into which the reference electrode was inserted so as to fix in such a manner that the forward end slightly projects to the inside of the pipe.

A doughnut-shaped plate made of tinanium having a surface which has the same configuration and dimension as that of the flange portion of the pipes was galvanized with platinum to make an electrode member.

Figure 3:
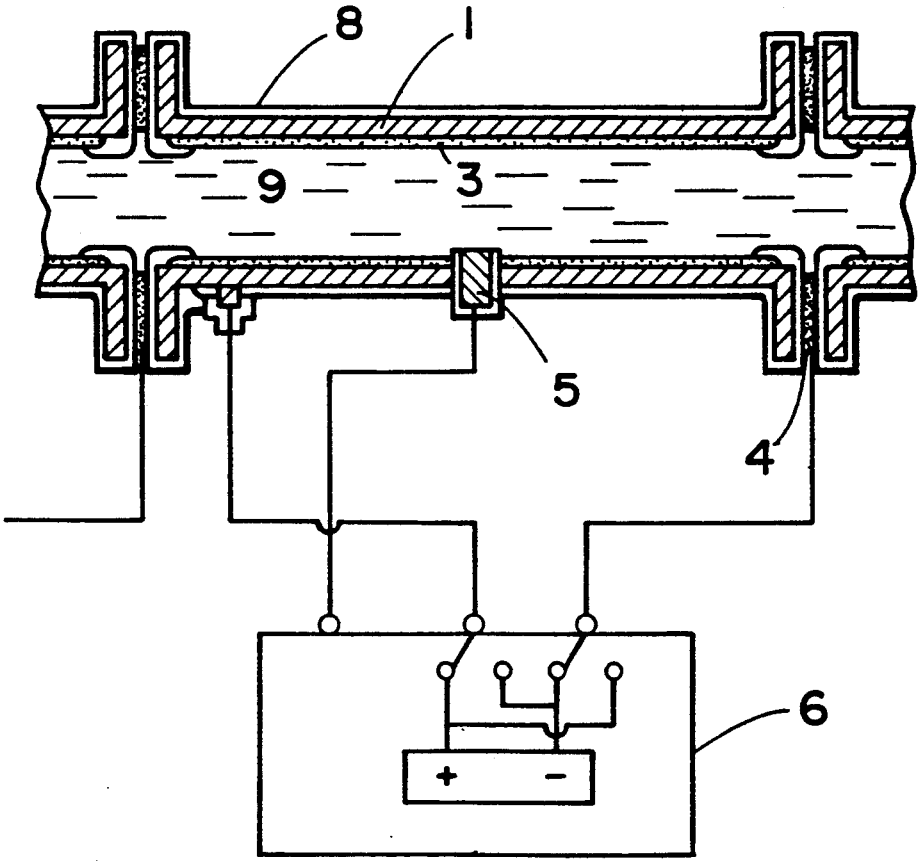

As shown in FIG. 3, the above mentioned steel pipes were jointed at the flanges with interposing the electrode member (4) to make a pipeline for testing. An anode terminal, a cathode terminal, and a reference electrode terminal of the direct current power supply (6) were wired to a connecting terminal, the electrode member, and the reference electrode (5) provided at each steel pipes by means of connecting cable. In FIG. 3, (8) is an insulating material.

Sea water was allowed to flow in this pipeline at a flow speed of 0.5 m/sec. Direct current application was performed with 40 to 100 mA per one steel pipe, and with controlling a potential difference between the anode and the reference electrode (SCE) to be in a range of 0.8 to 1.2 V, stain prevention of the pipeline was carried out.

As a result of investigation of the inside of the pipeline after one year, it was observed that marine organisms adhered only scatteringly.

For comparison, sea water was allowed to flow in a pipeline of a polyvinyl chloride pipe having the same bore diameter in the same manner as described above. Marine organisms adhered to the inside of this pipeline, and a thickness of which reached 10 mm after one year.

Example 2

As shown in FIG. 4, a stain prevention test was carried out for a water channel of concrete in which sea water flows at a speed of 0.3 m/sec.

A stainless steel plate with 1 m in width, 1 m in length, and 3 mm in thickness was used as the electric current feeding member (2), one surface of which was lined with the same conductive sheet (3) as Example 1 except that 100 parts by weight of butyl rubber was used instead of 100 parts by weight of chloroprene rubber, and other parts were coated with an insulating material (8) to prepare a stain preventing wall.

The stain preventing wall was arranged at the side face of the water channel so as to direct the side of the conductive sheet toward sea water, and an electrode member (4) of titanium rod galvanized with platinum was fixed at a position opposing to the stain preventing wall by supporting member respectively provided at the side face of the water channel. An anode terminal and a cathode terminal of the direct current power supply (6) were wired to the electric current feeding member and the electrode member, respectively.

A reference electrode (5) having been connected with the direct current power supply was introduced into the water channel, and while controlling a potential difference to the anode to be a range of 0.8 to 1.2 V, direct current of 150 to 600 mA was turned on. Even after one year, no adhesion of marine organisms was observed on the surface of the stain preventing wall.

A surface of a stainless plate having the same dimension was coated with polyvinyl chloride and the other surface was coated by painting, and the plate was immersed at the same position in the water channel. Marine organisms were adhered thereto, which grew to an extent that a thickness reached about 15 mm after one year. Moreover, the paint in the vicinity of junction with polyvinyl chloride was peeled off.

Example 3

A station ship (made of steel) of a cubic configuration with 1 m in width, 1 m in length, and 1 m in height was prepared for testing. Only the upper face of the station ship was coated with insulating material, and the other five faces were lined with the same conductive sheet as Example 1 except that 100 parts by weight of ethylnene propyrene rubber was used instead of 100 parts by weight of chloroprene rubber.

A rod-shaped electrode member made of titanium and galvanized with platinum was attached to the supporting member provided to the station ship.

An anode terminal of the direct current power supply was connected with the conductive sheet and a cathode terminal was connected with the electrode member, respectively, and a reference electrode connected with the reference electrode terminal was arranged to make a stain preventing apparatus as shown in FIG. 1.

Current application was performed for about 10 hours a day so as to make a potential difference to be in a range of 0.8 to 1.2 V. Even after one year, marine organisms adhered to the station ship only scatteringly.

To a station ship coated with polyvinyl chloride which was installed for comparison marine organisms adhered, the largest thickness of which reached 10 mm.

Example 4

As shown in FIG. 5, a stain prevention test was carried out for a ship's side.

On one surface of a steel plate to be used as an electric current feeding member (2) with 2 m in length, 1 m in width, and 3 mm in thickness, the same conductive sheet (3) as Example 1 was lined except that 100 parts by weight of fluorine rubber was used instead of 100 parts by weight of chloroprene rubber. Other parts were coated with insulating material (8) to prepare a stain preventing wall. The electric current feeding member (2) was connected with the anode terminal of the direct current power supply (6), and the above mentioned stain preventing wall was attached to a portion lower than the vicinity of the waterline so as to closely contact with the marine vessel.

A round rod of titanium with a side face platinum-galvanized and covered by an insulating tube was used as an electrode member (4), and a round rod of silver with a side face covered by an insulating tube was prepared as a reference electrode (5), which were connected with the cathode terminal and the reference electrode terminal of the direct current power supply, respectively.

During the ship being anchored, the electrode member and the reference electrode were immersed in sea water, and current application was performed so as to make a potential difference between the reference electrode and the anode to be in a range of 0.8 to 1.2 V, and during navigation, they were pulled up.

To the portion at which the stain preventing wall was provided, marine organisms adhered only scatteringly even after one year. They adhered to the other portions to grow to became a thickness of 10 mm after 6 months.

Example 5

As shown in FIG. 6, stain prevention of a bridge girder was carried out. One surface of a steel plate to be used as an electric current feeding member (2) was lined with the same conductive sheet (3) as Example 1 except that 100 parts by weight of chlorosulfonated polyethylene rubber, and other portions were lined with insulating material (8) to construct a stain preventing wall, and 4 sheets of which were prepared. They were fixed closely under the surface of the sea at a position surrounding the bridge girder which is the article subjected to stain prevention (1) with directing the conductive sheet (3) outwardly, and the electric current feeding member (2) was connected with the anode terminal of the direct current power supply (6).

Titanium rods galvanized with platinum having an arc configuration were arranged in front of each of stain preventing walls one by one to make a ring-shaped electrode member (4) which was connected with a cathode terminal of the direct current power supply.

A reference electrode (5) was introduced into sea water, and current application was performed so as to make the potential difference to the conductive sheet (3) to be in a range of 0.8 to 1.2 V.

As a result of inspection of adhesion of marine organisms after one year, there is little adhesion to this bridge girder, however, to the other bride girders, barnacle and the like adhered with a thickness of about 15 mm in spite of cleaning carried out one year ago.

Example 6

Stain prevention was carried out for a buoy in which generation of electricity is performed by wave force to lighten.

Figure 7:
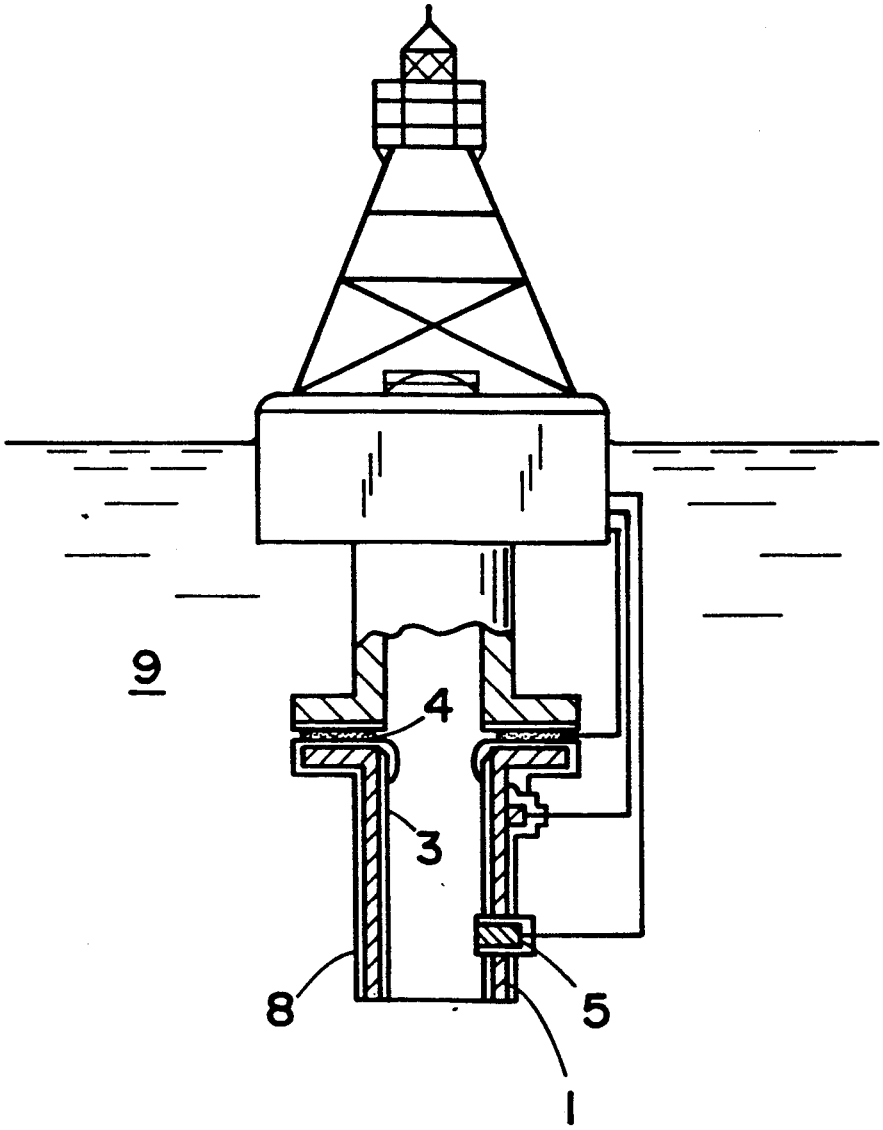

As shown in FIG. 7, a flange is provided at the middle of a leg portion for taking wave energy, to which the same coated steel pipe as Example 1 with interposing a packing and an electrode member (4) having a doughnut plate configuration was jointed.

Current application was performed under the same condition as Example 1. There is almost no adhesion of marine organisms to the internal surface of the leg portion even after one year, and no decrease in the ability of generation of electricity was observed.

To other buoys, in which no stain prevention treatment was performed, marine organisms adhered even to the internal surface of the leg portion, which could not take the wave energy sufficiently.

Example 7

With respect to a metal net having an opening portion of 30 mm × 30 mm, using mixed powder comprising 100 parts by weight of nylon, 10 parts by weight of carbon black, and 10 parts by weight of graphite, powder lining was carried out by means of the hot dip method to form a conductive coating film.

As shown in FIG. 2, a fish preserve was formed by surrounding all the sides with this metal net.

An insulating material (8) having a channel shaped profile was arranged to surround three sides of the fish preserve, to which a rod-shaped electrode (5) was located at the inside of the fish preserve. An anode terminal, a cathode terminal, and a reference electrode terminal of the direct current power supply (6) were connected with the metal net, the electrode member, and the reference electrode, respectively.

Current application was carried out for one year so as to make the potential difference between the conductive coating film and the reference electrode to be in a range of 0.8 to 1.2 V.

Little adhesion of marine organisms to the net was observed. A fishery net made of nylon having an opening portion of the same dimension suffered from closing of the mesh in the net within one month.

We claim:

1. A method for preventing stains due to adhesion of marine organisms to an article contacting with sea water, comprising the steps of: performing direct lining of a conductive sheet made of a conductive substance on a stain prevention-requiring portion of said article subjected to stain prevention; arranging an electrode member and a reference electrode in sea water so as not to contact with the conductive sheet; applying a direct electric current using the conductive sheet as an anode and the electrode member as a cathode and utilizing said article subjected to stain prevention as an electric current feeding member; allowing current to flow while measuring a potential difference between the reference electrode and the anode; and controlling the surface potential of the conductive sheet to be in a range of +0.5 to 1.5 V vs SCE so as to give electric shock to microorganisms which contact with the conductive sheet and thus prevent adhesion of microorganisms on said article.

2. A method for preventing stains due to adhesion of marine organisms to a net of contacting with sea water, comprising the steps of: forming a conductive coating film made of a conductive substance on the net arranging an electrode member and a reference electrode in sea water so as not to contact with the conductive coating film; applying a direct electric current using the conductive coating film as an anode and the electrode member as a cathode and utilizing the net as an electric current feeding member; allowing current to flow while measuring a potential difference between the reference electrode and the anode; and controlling the surface potential of the conductive coating film to be in a range of +0.5 to 1.5 V vs SCE so as to give electric shock to microorganisms which contact the conductive coating film and thus prevent adhesion of microorganisms on said net.

3. A method for preventing stains due to adhesion of marine organisms to an article contacting with sea water, comprising the steps of: arranging an electric current feeding member lined with a conductive sheet or an electric current feeding member covered with a conductive coating film closely near to a stain prevention-requiring portion of an article subjected to stain prevention; arranging an electrode member and a reference electrode in sea water so as not to contact with the conductive sheet or the conductive coating film; applying direct electric current using the conductive sheet or the conductive coating film as an anode and the electrode member as a cathode and passing the electric current through the feeding member to the anode; allowing current to flow while measuring a potential difference between the reference electrode and the anode; and controlling the surface potential of the conductive sheet or the conductive coating film to be in a range of +0.5 to 1.5 V vs SCE so as to give electric shock to microorganisms which contact with the conductive sheet or the conductive coating film and thus prevent adhesion of microorganisms on said article.

4. The stain preventing method according to any one of claims 1 to 3, wherein the polarity of the anode is sometimes alternated with the polarity of the cathode.

* * * * *